US006085789A

United States Patent [19]

Varney et al.

[11] Patent Number: 6,085,789

[45] Date of Patent: Jul. 11, 2000

[54] LIGHTWEIGHT SLEEVE AND SPOOL ARRANGEMENT FOR USE IN DIAPHRAGM PUMPS

[75] Inventors: James Varney, Rillton; Eldon S. Eady, Greensburg; Howard D. Huss, Westmoreland City, all of Pa.

[73] Assignee: Westinghouse Air Brake Company, Wilmerding, Pa.

[21] Appl. No.: 09/229,428

[22] Filed: Jan. 13, 1999

[51] Int. Cl.[7] ..... F15B 13/04

[52] U.S. Cl. ..... 137/625.69; 251/368

[58] Field of Search ..... 137/625.69; 251/368

[56] References Cited

U.S. PATENT DOCUMENTS 5,248,126 9/1993 Pruss et al. ..... 251/368

*Primary Examiner*—Gerald A. Michalsky
*Attorney, Agent, or Firm*—James Ray & Associates

[57] ABSTRACT

The present invention provides a lightweight sleeve and spool arrangement for use in certain pumps. Such lightweight sleeve and spool arrangement comprises a sleeve having a predetermined number of apertures and having a predetermined interior diameter. The sleeve is formed from a first predetermined plastic material selected from a group consisting of nylons, acetals, polysulfones, polyesters, polyetherimides and polyamide-imines. There is also a spool that has a predetermined configuration and a predetermined exterior diameter. Such predetermined exterior diameter being about 0.0005 inches smaller than the predetermined interior diameter of such sleeve. The spool is formed from a second predetermined plastic material selected from a group consisting of nylons, acetals, polysulfones, polyesters, polyetherimides and polyamide-imines.

11 Claims, 3 Drawing Sheets

LIGHTWEIGHT SLEEVE AND SPOOL ARRANGEMENT FOR USE IN DIAPHRAGM PUMPS

FIELD OF THE INVENTION

The present invention relates, in general, to diaphragm pumps used widely throughout industry and, more particularly, the present invention relates to a lightweight sleeve and spool arrangement for use in air-operated double diaphragm pumps.

BACKGROUND OF THE INVENTION

Diaphragm pumps have been used for a wide variety of applications throughout the industries employing pumps. One type of such diaphragm pumps is a double diaphragm air-operated pump. This type of pump generally employs a sleeve and spool arrangement in the center section of the pump to control the directional flow of air to the diaphragm.

Historically, these pumps have used a high quality stainless steel to manufacture the sleeve and a hard anodized aluminum for the spool. The radial tolerance of these items is approximately 0.002 inches. Further it is necessary that the spool have a diameter that is only slightly less than that of the sleeve. This difference is generally about 0.0005 inches. Because of these strict tolerances, the sleeve and spool arrangements are generally assembled and kept as matched sets. The parts are not necessarily interchangeable from one set to another. Not only is the cost of high quality stainless and hard anodized aluminum quite high, but the manufacturing costs for machining these matched sets to the tolerances required are also very high.

The cost associated with these sleeves and spools would be livable if the items had an exceptionally long service life. However, the useable service life for these sleeve and spool arrangements is far less than desirable. For a variety of reasons, after a period of time in service the spool binds in the sleeve and requires more effort to move it back and forth until it reaches a point where it can no longer be moved, thus making the pump inoperable.

Therefore, it would be advantageous to provide a sleeve and spool arrangement which would not only cost less for the base material but be easier to manufacture and have a longer useful service life.

SUMMARY OF THE INVENTION

The present invention provides a lightweight sleeve and spool arrangement for use in certain pumps. Such lightweight sleeve and spool arrangement comprises a sleeve having a predetermined number of apertures and having a predetermined interior diameter. The sleeve is formed from a first predetermined plastic material, such first predetermined plastic material being selected from a group consisting of nylons, acetals, polysulfones, polyesters, polyetherimides and polyamide-imines. There is also a spool that has a predetermined configuration and a predetermined exterior diameter. Such predetermined exterior diameter being about 0.0005 inches smaller than the predetermined interior diameter of such sleeve. The spool is formed from a second predetermined plastic material, such second predetermined plastic material being selected from a group consisting of nylons, acetals, polysulfones, polyesters, polyetherimides and polyamide-imines.

OBJECTS OF THE INVENTION

It is therefore one of the primary objects of the present invention to provide a lightweight material for sleeve and spool sets for use in double diaphragm pumps.

It is also an object of the present invention to provide a lightweight sleeve and spool set which will have a longer useful service life than is provided by the present technology.

It is still another object of the present invention to provide a lightweight sleeve and spool set which will be easier to manufacture.

Yet another object of the present invention is to provide a lightweight sleeve and spool set which will be less expensive to produce than is provided by the present technology.

In addition to the several objects and advantages of the present invention which has been described in some detail above, various other objects and advantages of the invention will become much more readily apparent to those persons who are skilled in pumping systems and, more particularly, to diaphragms used in such pumps from the following more detailed description of such invention, particularly, when such detailed description is taken in conjunction with the attached drawing Figures and with the appended claims.

BRIEF DESCRIPTION OF THE PRESENTLY PREFERRED AND VARIOUS ALTERNATE EMBODIMENTS OF THE INVENTION

Figure 1:
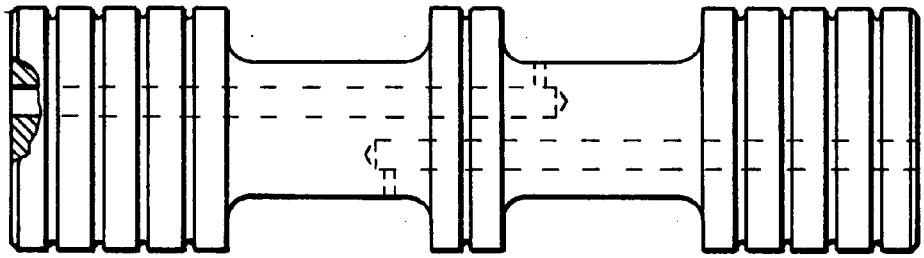
FIG. 1 PRIOR ART
FIG. 1 is a cross-sectional view of a prior art type spool used in double diaphragm pumps.
Figure 2:
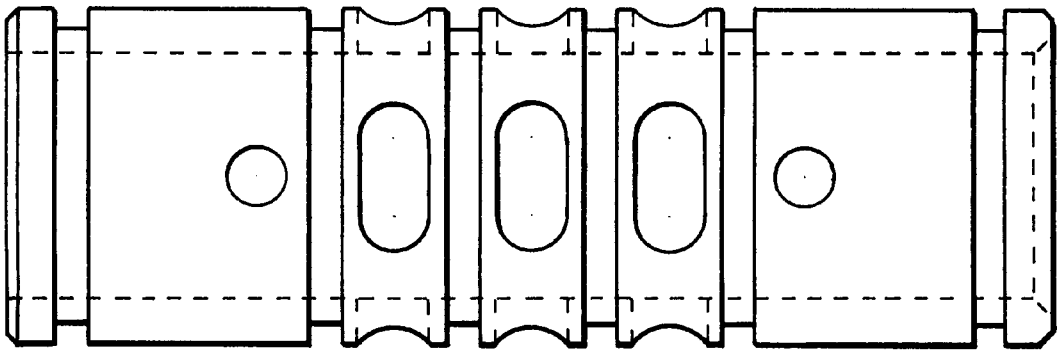
FIG. 2 PRIOR ART
FIG. 2 is a cross-sectional view of a prior art type sleeve used in double diaphragm pumps.
Figure 3:
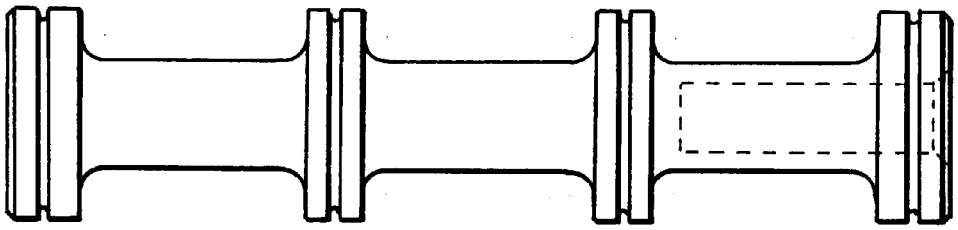
FIG. 3 PRIOR ART
FIG. 3 is a cross-sectional view of another prior art type spool used in double diaphragm pumps.
Figure 4:
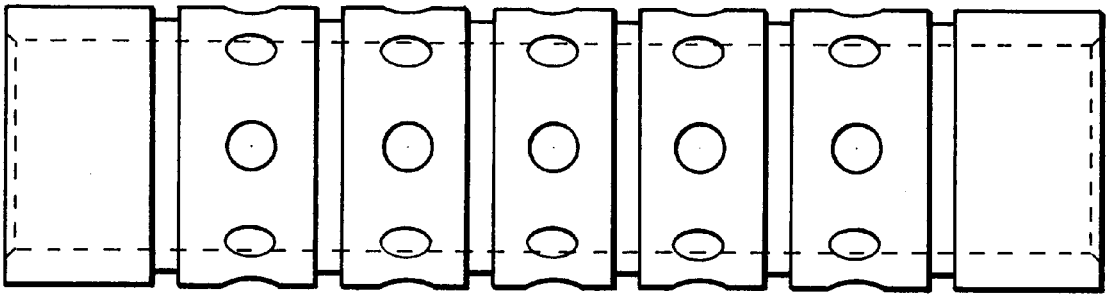
FIG. 4 PRIOR ART
FIG. 4 is a cross-sectional view of another prior art type sleeve used in double diaphragm pumps.
Figure 5:
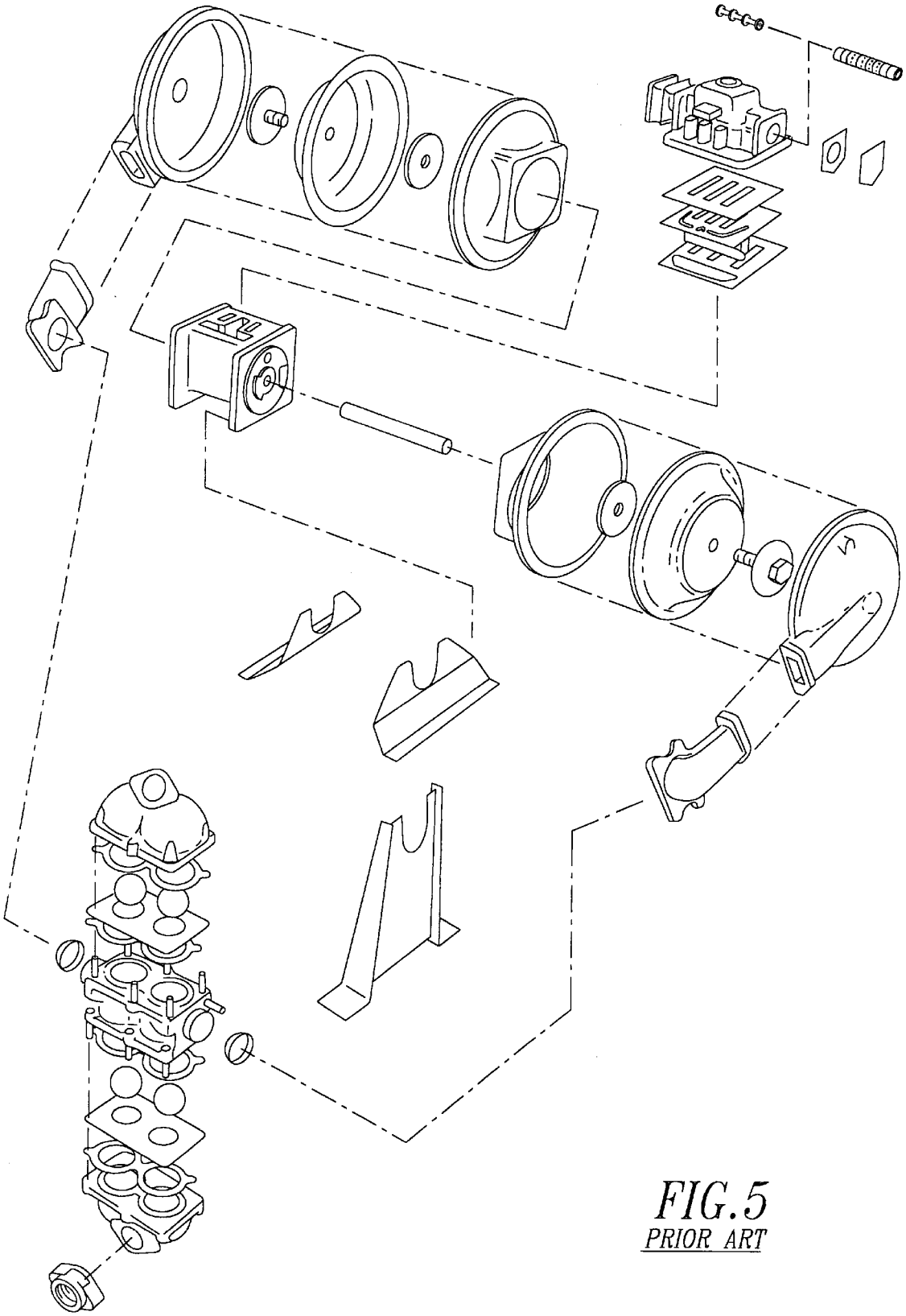
FIG.5 PRIOR ART
FIG. 5 is an exploded view of a prior art type double diaphragm pump which uses a sleeve and spool arrangement.

Reference is now made to prior art drawings FIG. 1 thru FIG. 4. Illustrated therein are two examples of various sleeve and spool arrangements. These are examples of sleeves and spools that are presently used in different size pumps and although they appear to be somewhat different, the function of the sleeve and spool is basically the same regardless of the size of the pump or the minor variations in their configuration. Sleeve and spool arrangements of this type have been commonly used throughout the pumping industry in the center section of air operated, double diaphragm pumps to control the directional flow of air to the diaphragm. Reference is now made to FIG. 5. Illustrated therein is a prior art type double diaphragm pump which utilizes a sleeve and spool arrangement.

In pumps of this type the diaphragms are connected by a common rod, one diaphragm performs the discharge stroke while the other is pulled to perform the suction stroke in the opposite chamber. The alternate pressuring and exhausting of the diaphragm chamber is performed by means of a pilot operated air distribution valve. This air distribution valve incorporates a sleeve and spool arrangement. When the spool shifts inside the sleeve to one end of the valve body, inlet air pressure is applied to one diaphragm chamber and the other diaphragm chamber exhausts. When the spool shifts to the opposite end of the valve body, the porting of the chambers is reversed. Thus, it is necessary for such spool and sleeve to be operating properly in order for the double diaphragm pump to operate. In the embodiment of the present invention there is no change in the basic configuration or operation of either the sleeve or the spool in either of the arrangements that are shown as prior art.

Historically, pump manufacturers have required that the sleeve be manufactured from a high quality stainless steel and that the spool be a hard anodized aluminum. The radial tolerance of these items is approximately 0.002 inches. Further it is necessary that the spool have a diameter that is only slightly less than that of the sleeve. This difference is generally about 0.0005 inches. Because of these strict tolerances, the sleeve and spool arrangements are generally assembled and kept as matched sets. Because it is important that the spool move freely within the sleeve without binding, the parts are not necessarily interchangeable from one set to another. Not only is the cost of high quality stainless steel and hard anodized aluminum quite high, but the manufacturing costs for machining these matched sets to the strict tolerances required are also very high. The present invention provides a lightweight sleeve and spool arrangement for use in such air operated, double diaphragm pumps. This lightweight sleeve and spool arrangement comprises a sleeve having a first predetermined configuration and having a predetermined interior diameter. Such first predetermined configuration includes having a predetermined number of apertures. The sleeve is formed from a first predetermined plastic material. In a first embodiment of the invention such first predetermined plastic material is selected from a group consisting of nylons, polysulfones, polyesters, polyetherimides and polyamide-imides. In a more preferred embodiment of the invention such plastic material is selected from a polyester and a polyamide-imide. It is presently preferred that such polyester is a polyethylene terephthalate. One such polyester is Ertalyte PET-P, which is a registered trademark of DSM Engineering Plastic Products, Inc. It is also presently preferred that such polyamide-imine is Torlon 4301 which is a registered trademark of Amoco Performance Products.

Further, there is a spool which has a predetermined configuration and has a predetermined exterior diameter. The predetermined exterior diameter of such spool is about 0.0005 inches smaller than the predetermined interior diameter of the sleeve. The spool is formed from a second predetermined plastic material. In a first embodiment of the invention, such second predetermined plastic material is selected from a group consisting of nylons, polysulfones, polyesters, polyetherimides and polyamideimides. In a more preferred embodiment of the invention such plastic material is selected from a polyester and a polyamideimide. It is presently preferred that such polyester is a polyethylene terephthalate. One such polyester is Ertalyte PET-P, which is a registered trademark of DSM Engineering Plastic Products, Inc. It is also presently preferred that such polyamide-imine is Torlon 4301 which is a registered trademark of Amoco Performance Products.

Also in a presently preferred embodiment of the invention such first predetermined plastic and such second predetermined plastic are identical.

It is very important that the material used to replace stainless steel have a very hard surface and be dimensionally stable because of the very strict tolerances that are required by the pump manufacturers. Polyamide-imides and polyethylene terephthalate polyesters provide the properties necessary to meet the required tight tolerances. Components made of either of these plastics offer a product with a very low expansion rate, a low coefficient of friction and exhibit little or no slip-stick while in use.

A sleeve and spool arrangement formed of the aforementioned polyamide-imide and polyethylene terephthalate polyester is considerably lighter in weight than the conventional stainless steel and aluminum that are presently used throughout the industry. Because the plastic in the present invention is lighter, less air pressure is required to move the spool within the sleeve. Such spool and sleeve are not only lighter but are considerably easier to manufacture than is the present technology. The cost of materials and the cost of forming such sleeve and spool are significantly less than the material costs and the costs associated with machining the conventional 440° C. stainless steel and the 6061-T6 hard anodized aluminum that are currently being used throughout the industry.

It is also foreseen that the sleeve and spool arrangements comprised of such predetermined plastic material will have a considerably longer service life than the present materials. The use of these plastics provide a material which has a low coefficient of friction and a low expansion rate which enables the spool to move in and out of the sleeve without binding for a longer period of time than what has been experienced with the present stainless and aluminum arrangements.

Sleeve and spool arrangements consisting of conventional 440° C. stainless steel and the 6061-T6 hard anodized aluminum have been used for many years and the present invention is the first to employ a completely different type of material in the formation of these components. The use of such materials in the present invention is a dramatic change over the materials that have been used previously. These materials provide a pump manufacturer with components that are significantly less costly, both in material costs and manufacturing costs. These materials are lighter in weight and have an extended service life thus making them more efficient.

While a presently preferred and an alternative embodiment of the present invention have been described in detail above, it should be understood that various other adaptations and/or modifications of the present invention can be made by those persons who are particularly skilled in the art related to pumping systems and, more particularly, with sleeve and spool arrangements that are used in double diaphragm pump systems without departing from either the spirit of the invention or the scope of the appended claims.

We claim:

1. A lightweight sleeve and spool arrangement for use in certain pumps, said light weight sleeve and spool arrangement comprising:

(a) a sleeve having a predetermined number of apertures and having a predetermined interior diameter, said sleeve being formed from a first predetermined plastic material selected from a group consisting of nylons, acetals, polysulfones, polyesters, polyetherimides and polyamide-imines; and (b) a spool having a predetermined configuration having a predetermined exterior diameter, said predetermined exterior diameter being about 0.0005 inches smaller than said predetermined interior diameter, said spool being formed from a second predetermined plastic material selected from a group consisting of nylons, acetals, polysulfones, polyesters, polyetherimides and polyamide-imines.

2. A lightweight sleeve and spool arrangement for use in certain pumps, according to claim 1, wherein said first predetermined plastic material is selected from one of a polyamide-imine and a polyester.

3. A lightweight sleeve and spool arrangement for use in certain pumps, according to claim 2, wherein said first predetermined plastic material is a polyamide-imine.

4. A lightweight sleeve and spool arrangement for use in certain pumps, according to claim 2, wherein said first predetermined plastic material is a polyester.

5. A lightweight sleeve and spool arrangement for use in certain pumps, according to claim 4, wherein said polyester is a polyethylene terephthalate.

6. A lightweight sleeve and spool arrangement for use in certain pumps, according to claim 1, wherein said second predetermined plastic material is selected from one of a polyamide-imine and a polyester.

7. A lightweight sleeve and spool arrangement for use in certain pumps, according to claim 6, wherein said second predetermined plastic material is a polyamide-imine.

8. A lightweight sleeve and spool arrangement for use in certain pumps, according to claim 6, wherein said second predetermined plastic material is a polyester.

9. A lightweight sleeve and spool arrangement for use in certain pumps, according to claim 8, wherein said polyester is a polyethylene terephthalate.

10. A lightweight sleeve and spool arrangement for use in certain pumps, according to claim 1, wherein said first predetermined plastic and said second predetermined plastic are identical.

11. A lightweight sleeve and spool arrangement for use in certain pumps, according to claim 1, wherein said lightweight sleeve and spool arrangement is disposed in a double diaphragm pump.

* * * * *